United States Patent [19]

de Pous

[11] 4,335,473

[45] Jun. 22, 1982

[54] WATER RESERVOIRS, PARTICULARLY SWIMMING POOLS

[75] Inventor: Bernard de Pous, Villefranche de Lauragais, France

[73] Assignee: Zodiac, Saint-Cloud, France

[21] Appl. No.: 170,837

[22] Filed: Jul. 16, 1980

[30] Foreign Application Priority Data

Jul. 18, 1979 [FR] France ..... 79 18652

[51] Int. Cl.[3] ..... E04H 3/18

[52] U.S. Cl. ..... 4/488; 4/506; 4/584; 4/588

[58] Field of Search ..... 4/661, 583, 588, 488, 4/489, 506, 584

[56] References Cited

U.S. PATENT DOCUMENTS

| | | | |
|---|---|---|---|
| 2,443,440 | 6/1948 | Alvarez | 4/506 |
| 2,471,302 | 5/1949 | Bowand | 4/588 |
| 2,505,845 | 5/1950 | Alvarez | 4/506 X |
| 2,529,872 | 11/1950 | Hasselquist | 4/506 |
| 2,616,096 | 11/1962 | Hassalquist | 4/506 |
| 2,689,812 | 9/1954 | Mollica et al. | 4/506 X |
| 2,714,726 | 8/1955 | Hasselquist | 4/506 |
| 2,718,014 | 9/1955 | Mizrach et al. | 4/506 |
| 2,990,837 | 7/1961 | Cushman | 4/506 X |
| 3,001,207 | 9/1961 | Nail | 4/506 |
| 3,058,122 | 10/1962 | McDaniel et al. | 4/588 |
| 3,363,268 | 1/1968 | Friedlander | 4/506 |
| 3,631,544 | 1/1972 | Tytel | 4/506 |
| 4,068,326 | 1/1978 | Deschler | 4/588 |

*Primary Examiner*—Henry K. Artis

*Attorney, Agent, or Firm*—Cushman, Darby & Cushman

[57] ABSTRACT

Water reservoir comprising a flexible bottom and side walls formed by at least one inflatable tubular element extending along a closed contour, said bottom and said tubular element resting on a support.

The bottom is connected to the tubular element by a peripheral connection zone extending between a line of the bottom parallel to the tubular element and spaced therefrom and a generatrix of the tubular element situated between the lower horizontal tangency generatrix and the inner vertical tangency generatrix of the tubular element. A brace is provided between the bottom line and said generatrix.

5 Claims, 1 Drawing Figure

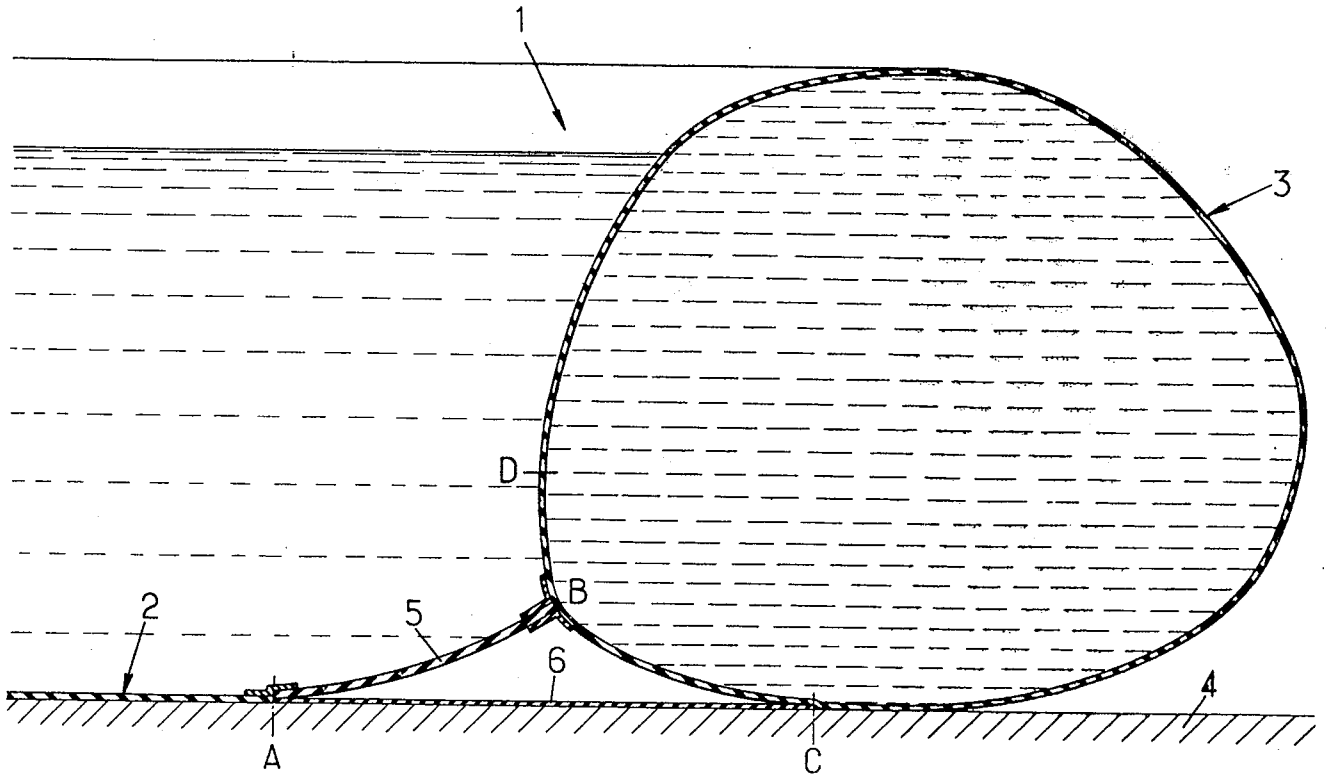
1
2
3
4
5
6
A
B
C
D

WATER RESERVOIRS, PARTICULARLY SWIMMING POOLS

The present invention relates to improvements to water reservoirs, particularly swimming pools, comprising a flexible bottom and side walls formed from at least one inflatable tubular element extending along a closed contour, said bottom and said tubular element being intended to rest on a support.

Reservoirs of this kind are known in which the tubular element extends substantially circularly, the bottom resting over the whole of its surface on the support. In this case, the thrust of the water is exerted radially on the tubular element; however, since this latter is circular, the general resultant of the forces exerted on the tubular element is zero and this latter undergoes no appreciable deformation.

On the other hand, in the case where the reservoir is of a polygonal shape, the rectilinear section of the tubular element forming the side walls cannot have an excessive length because they no longer offer sufficient resistance to the thrust of the water and are locally deformed (particularly in the median zones of the section) letting water flow away.

Consequently, if it is not desired to use tubular element sections of too large a diameter with respect to the overall dimensions of the reservoir, it is impossible in accordance with the present constructional criteria to construct a polygonal reservoir, and particularly a quandrangular (rectangular or square) reservoir of large dimensions.

Now, in particular in the case of swimming pools, a quandrangular reservoir (especially a rectangular one) is more advantageous than a round reservoir, for it can be more easily disposed on a piece of ground (in general rectangular) of given dimensions and especially since it has a larger area than a round reservoir inscribed in this rectangle.

The invention then aims at palliating the above-mentioned disadvantages, by constructing water reservoirs of the above-mentioned kind so that it is possible to give them large dimensions even in the case where they are polygonal in shape, particularly rectangular in shape.

To this end, in accordance with the invention, it is arranged for the bottom to be connected to the tubular element by a peripheral connecting zone extending between a line of the bottom parallel to the tubular element and spaced therefrom, and a generatrix of said tubular element situated between the lower horizontal tangency generatrix and the inner vertical tangency generatrix of said tubular element, and for a brace to be disposed between said bottom line and the lower horizontal tangency generatrix of the tubular element.

With this arrangement, there is provided in the peripheral zone connecting the bottom with the tubular element or with the tubular element sections a continuous rigidifying element—i.e. extending over the whole length of the tubular element or the tubular element sections—which opposes deformation of the tubular element or of the tubular element sections, particularly in the median regions thereof.

The mechanical resistance of the assembly is independent of the length of the tubular element sections, and it is then possible to construct water reservoirs having dimensions as large as desired, even in the case where the reservoirs are quandrangular in shape, e.g. rectangular or square.

In a preferred embodiment, the peripheral connecting zone is continuous and water tight, the brace then being able to comprise a plurality of flexible discontinuous ties spread out over the periphery of the water reservoir; but in another embodiment, the connection zone may be discontinuous.

In one or other of the preceding cases, the brace may be continuous and water tight.

In one or the other case, it is desirable for the peripheral connecting zone to be reinforced.

The invention will be better understood from reading the following description of one of its preferred embodiments given by way of illustrative example without any limiting character. In this description, reference is made to the accompanying drawing in which the single FIGURE shows in secton a reservoir portion arranged in accordance with the invention.

Reservoir 1 comprises a flexible bottom 2—formed by a sheet of any appropriate sealing material—and side walls formed by a tubular element or by rectilinear tubular element sections 3 maintained under pressure.

Bottom 2 and the tubular element or tubular element sections 3 rest on a support 4, in general the ground.

Bottom 2 is connected to tubular element 3 by a peripheral connection zone 5 which extends between a line A on the bottom parallel to tubular element 3 and spaced therefrom and a generatrix B of tubular element 3 situated between the lower horizontal tangency generatrix C and the inner vertical tangency generatrix D (i.e. situated inwardly of the reservoir) of said tubular element. In other words, between points A and B, peripheral connection zone 5 does not rest on support 4 but extends thereabove. Furthermore, to prevent zone 5 from collapsing, it is desirable to provide, between lines A and C, a brace 6 which is advantageously formed by a stretched flexible tie.

The thrust of the water exerted on tubular element 3 and tending to deform this latter outwardly of the reservoir is buttressed by connection zone 5 and brace 6 which, bearing on the flat part of bottom 2, exert on the tubular element a retaining force directed inwardly of the reservoir.

Moreover, the presence of brace 6 facilitates the correct mutual positioning of the tubular element and of the bottom during positioning of the reservoir.

Although there is nothing formally opposed thereto, it is not necessary for zone 5 and brace 6 to both extend continuously at the periphery of the reservoir.

Preferably it is zone 5, formed from a flexible impermeable material, which extends continuously along the tubular element and brace 6 is formed by an assembly of straps spaced apart from each other along the periphery of the reservoir. In this case, the weight of the water above zone 5 exerts thereon a force having a component which is directed inwardly of the reservoir and which contributes to offsetting the thrust of the water acting on the tubular element.

However, it is also possible to envisage the reverse arrangement in which zone 5 is formed by straps and brace 6 is then formed by a flexible and water-tight sheet which extends continuously at the periphery of the reservoir.

With these arrangements, the thrust force of the water on the tubular element is taken up by zone 5 at all points of the periphery of the reservoir, whatever the form thereof.

Thus, it is certainly possible to form circular shaped reservoirs but it is also possible to form reservoirs having a polygonal shape whose walls are formed from rectilinear tubular element sections. In particular, it is possible to design large sized reservoirs rectangular in shape.

Bottom 2, when the reservoir is full, is pressed against support 4 by the weight of the water, is not subjected to any appreciable tension and may then be formed by a relatively thin film of a water-tight material.

On the other hand, peripheral connecting zone 5, on which are exerted the stresses retaining the tubular element, must be mechanically resistant and have a greater thickness to be determined depending on the material forming it and on the stresses which it withstands.

As shown in the single FIGURE, it is preferable for tubular element 3 to be filled with water under a low pressure which, on the one hand, avoids air-sealing problems posed by tubular elements inflated with air under pressure and, on the other hand, provides a considerable weight improving the stability of the reservoir.

Of course, tubular element 3 may have any desired configuration and be formed either by a single tubular element (case shown in the FIGURE) or by several tubular elements.

As is evident and as it follows moreover already from what has gone before, the invention is in no wise limited to those of its modes of application and embodiments which have been more especially considered; it embraces, on the contrary, all variations thereof.

I claim:

1. A liquid reservoir having a polygonal outer contour capable of resting on a supporting surface, comprising:

a. a flexible bottom;

b. side walls comprising at least one substantially straight inflatable tubular element extending along a closed contour defined by said bottom;

c. a peripheral connecting zone for connecting said bottom to said tubular element wherein said peripheral connecting zone risingly extends from a line on said bottom which is parallel to said tubular element but spaced apart therefrom to a generatrix located on said tubular element, said generatrix being situated between the lower-horizontal-tangency generatrix and the inner-bottomside-vertical-tangency generatrix of said tubular element; and d. at least one brace extending from said line on said bottom to said lower bottom-horizontal-tangency generatrix of said tubular element.

2. A liquid reservoir according to claim 1, wherein said brace comprises a plurality of flexible discontinuous ties spaced apart along the periphery of said reservoir.

3. A liquid reservoir according to claim 1, wherein said brace is continuous and water tight.

4. A liquid reservoir according to claim 1, wherein said peripheral connecting zone is reinforced.

5. A liquid reservoir according to claim 1, wherein said tubular element is filled with liquid under pressure.

* * * * *